US009796953B2

(12) United States Patent
Kumagai et al.

(10) Patent No.: US 9,796,953 B2
(45) Date of Patent: Oct. 24, 2017

(54) CLEANING LIQUID FOR LITHOGRAPHY AND METHOD FOR CLEANING SUBSTRATE

(71) Applicant: TOKYO OHKA KOGYO CO., LTD., Kawasaki-shi (JP)

(72) Inventors: Tomoya Kumagai, Kawasaki (JP); Naohisa Ueno, Kawasaki (JP); Mai Sugawara, Kawasaki (JP)

(73) Assignee: TOKYO OHKA KOGYO CO., LTD., Kawasaki-Shi (JP)

( * ) Notice: Subject to any disclaimer, the term of this patent is extended or adjusted under 35 U.S.C. 154(b) by 104 days.

(21) Appl. No.: 14/925,034

(22) Filed: Oct. 28, 2015

(65) Prior Publication Data

US 2016/0122695 A1 May 5, 2016

(30) Foreign Application Priority Data

Oct. 31, 2014 (JP) ..... 2014-223711

(51) Int. Cl.

| | |
|---|---|
| ***C11D 7/50*** | (2006.01) |
| ***C11D 7/32*** | (2006.01) |
| ***C11D 7/26*** | (2006.01) |
| ***C11D 11/00*** | (2006.01) |
| ***C23F 11/10*** | (2006.01) |
| ***C23G 1/16*** | (2006.01) |

(52) U.S. Cl.

CPC ..... *C11D 7/3281* (2013.01); *C11D 7/265* (2013.01); *C11D 7/3209* (2013.01); *C11D 7/5022* (2013.01); *C11D 11/0047* (2013.01); *C23F 11/10* (2013.01); *C23G 1/16* (2013.01)

(58) Field of Classification Search

CPC ... C11D 11/0047; C11D 7/265; C11D 7/3209; C11D 7/08; C11D 7/5013; C11D 7/5004

USPC ..... 510/175

See application file for complete search history.

(56) References Cited

U.S. PATENT DOCUMENTS

| | | | | |
|---|---|---|---|---|
| 2004/0121937 | A1 | 6/2004 | Yokoi et al. | |
| 2006/0293208 | A1* | 12/2006 | Egbe | C11D 7/3263 510/407 |
| 2011/0237480 | A1* | 9/2011 | Mizutani | C11D 7/261 510/175 |
| 2011/0281436 | A1* | 11/2011 | Inaba | C11D 7/265 438/710 |

FOREIGN PATENT DOCUMENTS

| | | |
|---|---|---|
| JP | 2002-357908 | 12/2002 |
| JP | 2004-103771 | 4/2004 |

* cited by examiner

*Primary Examiner* — Gregory Webb

(74) *Attorney, Agent, or Firm* — Knobbe Martens Olson & Bear LLP

(57) ABSTRACT

A cleaning liquid for lithography that is capable of removing residual material which remains after an etching process, as well as suppressing corrosion of at least one of cobalt and alloys thereof, and a method for cleaning a substrate using the cleaning liquid. The cleaning liquid for lithography includes hydroxylamine, at least one basic compound selected from amine compounds other than hydroxylamine, and quaternary ammonium hydroxides, and water, and has a pH value of 8 or higher. The cleaning liquid is used in cleaning a substrate containing at least one of cobalt and alloys thereof.

18 Claims, 1 Drawing Sheet

CLEANING LIQUID FOR LITHOGRAPHY AND METHOD FOR CLEANING SUBSTRATE

This application claims priority to Japanese Patent Application No. 2014-223711, filed Oct. 31, 2014, the content of which is incorporated herein by reference.

BACKGROUND OF THE INVENTION

Field of the Invention

The present invention relates to a cleaning liquid for lithography (hereinafter also simply referred to as "cleaning liquid") and a method for cleaning a substrate with this cleaning liquid.

Related Art

Semiconductor devices include a metallic wiring layer, a low dielectric layer, and an insulating layer or the like stacked on a substrate such as a silicon wafer and are manufactured by forming each of these layers through processing by a lithography method in which etching is carried out using a resist pattern as a mask.

The resist film or a temporary stacked film (also known as "a sacrificial film") used in the lithography method, and furthermore residue materials that derive from the metallic wiring layer and low dielectric layer and are produced during the etching process, are removed with a cleaning liquid to prevent an adverse effect on the semiconductor device, and furthermore to prevent impediment to a subsequent processing step.

Cleaning liquids composed mainly of quaternary ammonium hydroxides have hitherto been proposed as cleaning liquids for lithography for use in such manufacturing processes for semiconductor devices (see, for example, Patent Documents 1 and 2). Such cleaning liquids composed mainly of quaternary ammonium compounds have a significantly improved capability of removing various residue materials over previously used cleaning liquids and are excellent in the function of suppressing corrosion of easily corroded materials.

Patent Document 1: Japanese Unexamined Patent Application, Publication No. 2002-357908

Patent Document 2: Japanese Unexamined Patent Application, Publication No. 2004-103771

SUMMARY OF THE INVENTION

In recent years, methods for forming wiring using a damascene method have been employed in response to advances in high-density and highly integrated semiconductor devices. Copper that is prone to undergo corrosion is used as a metallic wiring material that configures the metallic wiring layer of the semiconductor device in this type of wiring formation method. Furthermore, a low dielectric constant material (also referred to as a "Low-k material") is used to configure the low dielectric constant layer. Advances in achieving a low dielectric constant have resulted in the use of such Low-k materials that are prone to undergo corrosion. In addition, tungsten and cobalt have been employed in a unit form or an alloy form as capping materials for metallic wiring in semiconductor devices.

However, while conventional cleaning liquids have an excellent function of suppressing corrosion of copper, Low-k materials and tungsten, they are poor in the function of suppressing the corrosion of cobalt and alloys thereof. This has therefore posed a problem in that, when an attempt is made to remove residue materials, which remain after etching of a substrate including a metallic wiring layer having a surface capped with cobalt or an alloy thereof, with cleaning liquids, cobalt or the alloy thereof is easily corroded. A cleaning liquid for lithography has therefore been desired that is excellent in removal of residue materials that remain after etching, as well as in suppression of the corrosion of cobalt and alloys thereof.

The present invention has been made in the light of the conventional circumstances as described above, and an object of the present invention is to provide a cleaning liquid for lithography that is excellent in removal of a residue material which remains after the etching process, as well as in suppression of corrosion of at least one metal selected from the group consisting of cobalt and alloys thereof, and a method for cleaning a substrate using the cleaning liquid.

The present inventors have made extensive and intensive studies with a view to solving the above problems. As a result, the present inventors have found that the above problems can be solved by adding hydroxylamine to the cleaning liquid for lithography and, further, setting the pH value of the cleaning liquid for lithography to 8 or higher, and the present has been completed based on such findings. Specifically, the present invention provides the following matters.

According to a first aspect of the present invention, there is provided a cleaning liquid for lithography, the cleaning liquid comprising: hydroxylamine; at least one basic compound selected from the group consisting of amine compounds other than hydroxylamine, and quaternary ammonium hydroxides; and water, the cleaning liquid having a pH value of 8 or higher.

According to a second aspect of the present invention, there is provided a method for cleaning a substrate, the method comprising cleaning the surface of a substrate having a metallic area using the above cleaning liquid, the metallic area having, on at least a part of a surface thereof, a metallic layer formed of at least one metal selected from the group consisting of cobalt and alloys thereof.

According to a third aspect of the present invention, there is provided a method for cleaning a substrate, the method comprising: forming an etching mask layer of a predetermined pattern on the surface of a substrate having a metallic area, the metallic area having, on at least a part of a surface thereof, a metallic layer formed of at least one metal selected from the group consisting of cobalt and alloys thereof; etching the substrate exposed from the etching mask layer; and cleaning the etched substrate with the above cleaning liquid, wherein, in the cleaning, at least a part of the metallic layer is exposed on the surface of the substrate.

According to a fourth aspect of the present invention, there is provided a method for etching a substrate, the method comprising: forming an etching mask layer of a predetermined pattern on the surface of a substrate having a metallic area, the metallic area having, on at least a part of a surface thereof, a metallic layer formed of at least one metal selected from the group consisting of cobalt and alloys thereof; etching the substrate exposed from the etching mask layer; and cleaning the etched substrate with the above cleaning liquid, wherein, in the cleaning, at least a part of the metallic layer is exposed on the surface of the substrate.

The present invention can provide a cleaning liquid for lithography that is excellent in removal of a residue material which remains after the etching process, as well as in suppression of corrosion of at least one metal selected from the group consisting of cobalt and alloys thereof, and a method for cleaning a substrate using the cleaning liquid.

BRIEF DESCRIPTION OF THE DRAWINGS

FIGS. 1A and 1B illustrate an etching mask layer formation step in which an etching mask layer 12 of a predetermined pattern is formed on the surface of a substrate 10 having a metallic area 11, the metallic area 11 having on at least a part of a surface thereof, a metallic layer 1.

FIGS. 1B and 1C illustrate an etching step in which the substrate 10 exposed from the etching mask layer 12 is etched to form concaves 13, and at least a part of the metallic layer 1 is exposed on the surface of the substrate 10 by formation of the concaves 13.

FIG. 1D illustrates a cleaning step in which the etched substrate 10 is cleaned with the cleaning liquid 14.

DETAILED DESCRIPTION OF THE INVENTION

Cleaning Liquid for Lithography

Figure 1A:
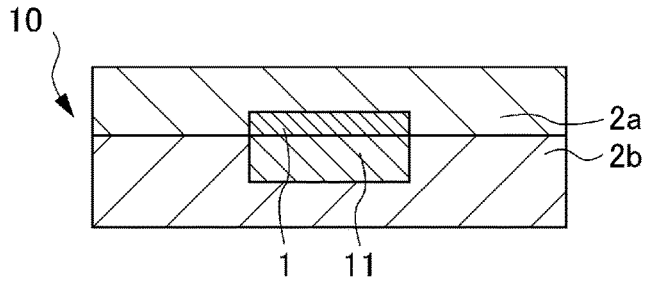
FIGS. 1A-D is a vertical cross-sectional view illustrating a method for cleaning a substrate in one embodiment of the present invention.

The cleaning liquid for lithography according to the present invention contains hydroxylamine; at least one basic compound selected from the group consisting of amine compounds other than hydroxylamine, and quaternary ammonium hydroxides; and water, and has a pH value of 8 or higher. The cleaning liquid according to the present invention is used, for example, for cleaning a substrate containing at least one metal selected from the group consisting of cobalt and alloys thereof. One example of the use of the cleaning liquid is cleaning a substrate including a metallic area having, on at least a part of the surface thereof, a metallic layer formed of the above metal (for example, a metallic area in which at least a part of the surface thereof is capped with a metallic layer formed of the above metal). At least a part of the metallic layer may be exposed on the surface of the substrate. For example, a capping layer for a metallic wiring may be mentioned as the metallic layer. Examples of substrates include those including, for example, a metallic wiring layer, a low dielectric layer, an insulating layer or the like stacked on a substrate such as a silicon wafer to form a semiconductor device. Examples of materials that constitute the metallic area include copper. The cleaning liquid according to the present invention has an excellent function of suppressing corrosion of at least one metal selected from the group consisting of cobalt and alloys thereof. By virtue of this, even when the cleaning liquid according to the present invention comes into contact with the metallic layer during cleaning of the substrate, the corrosion of the metallic layer is well suppressed.

For example, metallic wiring layers, plugs, and other metallic structures in substrates with semiconductor devices formed thereon may be mentioned as the metallic area. Alloys of cobalt with at least one of other transition elements and typical elements (for example, phosphorus, boron, and silicon) may be mentioned as the cobalt alloy, and specific examples thereof include alloys containing phosphorus and/or boron, such as CoWPB, and silicides such as CoSi.

The cleaning liquid according to the present invention has a pH value of 8 or higher, preferably 11 or higher, more preferably 11 to 13.5. When the pH value is 8 or higher, the capability of removing residue materials that remain after the etching process can easily be enhanced while suppressing the corrosion of at least one metal selected from the group consisting of cobalt and alloys thereof. When the pH value is 11 or higher, the capability of removing residue materials that remain after the etching process can easily be enhanced while further effectively suppressing the corrosion of at least one metal selected from the group consisting of cobalt and alloys thereof. As described later, when the cleaning liquid according to the present invention contains an organic acid, the pH value is preferably at least 8 and lower than 11, more preferably 8 to 10.

Individual components of the cleaning liquid according to the present invention are described in more detail hereafter. The above components may be commercially available products, unless otherwise specified.

[Hydroxylamine]

The cleaning liquid according to the present invention contains hydroxylamine and thus has an excellent capability of removing residue materials that remain after the etching process. The content of hydroxylamine is preferably not less than 6% by mass, more preferably 6 to 15% by mass, still more preferably 6 to 10% by mass relative to the total amount of the cleaning liquid. When the hydroxylamine content is in the above-defined range, the capability of removing residue materials that remain after the etching process can be enhanced. Especially when the cleaning liquid according to the present invention has a pH value of 11 or higher, the hydroxylamine content in the above-defined range is advantageous in that the capability of removing residue materials that remain after the etching process can be particularly improved.

[Basic Compound]

The basic compound is not particularly limited as long as the basic compound is at least one compound selected from the group consisting of amine compounds other than hydroxyl amine, and quaternary ammonium hydroxides. In the cleaning liquid according to the present invention, the basic compound is used for the adjustment of pH of the cleaning liquid and is particularly useful for maintaining the pH value at 11 or higher. Each of the amine compounds and the quaternary ammonium hydroxides may be used solely or may be used in a combination of two or more thereof.

Amine compounds having a cyclic structure are preferred as the amine compounds other than hydroxylamine from the viewpoint of more effectively suppressing the corrosion of at least one metal selected from the group consisting of cobalt and alloys thereof while ensuring the capability of removing residue materials that remain after the etching process. In amine compounds having a cyclic structure, the amino group may be present in either or both of the inside and outside of the cyclic structure. Examples of amine compounds having a cyclic structure include tetrahydrofurfurylamine, N-(2-aminoethyl)piperazine, 1,8-diazabicyclo[5.4.0]undecene-7, 1,4-diazabicyclo[2.2.2]octane, hydroxyethylpiperazine, piperazine, 2-methylpiperazine, trans-2,5-dimethylpiperazine, cis-2,6-dimethylpiperazine, 2-piperidine methanol, cyclohexylamine, and 1,5-diazabicyclo[4,3,0]nonene-5.

Examples of quaternary ammonium hydroxides include compounds represented by the following general formula (a1).

(a1)

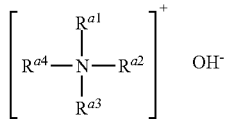

In the general formula (a1), $R^{a1}$ to $R^{a4}$ each independently represent an alkyl group having 1 to 16 carbon atoms, an aryl group having 6 to 16 carbon atoms, an aralkyl group having 7 to 16 carbon atoms, or a hydroxyalkyl group having 1 to 16 carbon atoms. At least two of $R^{a1}$ to $R^{a4}$ together may combine to form a cyclic structure. In particular, at least one of a combination of $R^{a1}$ and $R^{a2}$ and a combination of $R^{a3}$ and $R^{a4}$, that is, $R^{a1}$ and $R^{a2}$ and/or $R^{a3}$ and $R^{a4}$, together combine to form a cyclic structure.

Among compounds represented by the general formula (a1), the quaternary ammonium hydroxide is preferably at least one selected from the group consisting of tetramethylammonium hydroxide, tetraethylammonium hydroxide, tetrapropylammonium hydroxide, tetrabutylammonium hydroxide, methyltripropylammonium hydroxide, methyltributylammonium hydroxide, ethyltrimethylammonium hydroxide, dimethyldiethylammonium hydroxide, benzyltrimethylammonium hydroxide, hexadecyltrimethylammonium hydroxide, (2-hydroxyethyl)trimethylammonium hydroxide, and spiro-(1,1')-bipyrrolidinium hydroxide because of easy availability thereof. More preferred are tetramethylammonium hydroxide, tetrabutylammonium hydroxide, and benzyltrimethylammonium hydroxide.

As for the content of the basic compounds relative to the total amount of the cleaning liquid, the content of the amine compound other than hydroxylamine is preferably 0.1 to 50% by mass, more preferably 1 to 45% by mass, and the content of the quaternary ammonium hydroxide is preferably 0.05 to 10% by mass, more preferably 0.1 to 5% by mass. When the content is in the above-defined range, the pH value of the cleaning liquid can be maintained in a desired range of 8 or higher, particularly in a range of 11 or higher, and the capability of removing residue materials that remain after the etching process can be enhanced while suppressing the corrosion of at least one metal selected from the group consisting of cobalt and alloys thereof. When the cleaning liquid contains an organic acid, the basic compound is used in combination with the organic acid and, at the same time, the content of the basic compound is in the above-defined range, the pH value can be maintained in a desired range of 8 or higher, particularly in a range of at least 8 to lower than 11 and the capability of removing residue materials that remain after the etching process can be enhanced while suppressing the corrosion of at least one metal selected from the group consisting of cobalt and alloys thereof.

[Water]

The content of water is preferably 10 to 80% by mass, more preferably 20 to 75% by mass, still more preferably 25 to 70% by mass, relative to the total amount of the cleaning liquid. When the content of water is in the above-defined range, water as a solvent can dissolve other components particularly stably and homogeneously.

[Organic Acid]

The cleaning liquid according to the present invention may further contain an organic acid. In the cleaning liquid according to the present invention, the organic acid is used to adjust the pH of the cleaning liquid and is particularly useful for maintaining the pH value in a range of at least 8 to lower than 11, preferably 8 to 10. Organic acids may be used solely or in a combination of two or more thereof.

Organic acids include, for example, carboxylic acids, organic sulfonic acids, organic thiocarboxylic acids, and organic dithiocarboxylic acids. The carboxylic acid is not particularly limited as long as the compound contains a carboxyl group. Examples thereof include hydroxycarboxylic acids (that is, carboxylic acids with at least one hydrogen atom bonded to a carbon atom other than the carbonyl carbon atom substituted by a hydroxyl group), mercaptocarboxylic acids (that is, carboxylic acids with at least one hydrogen atom bonded to a carbon atom other than the carbonyl carbon atom substituted by a mercapto group. Specific examples of carboxylic acids include citric acid, thioglycollic acid, gallic acid, lactic acid, formic acid, oxalic acid, acetic acid, propionic acid, malonic acid, succinic acid, glutaric acid, maleic acid, fumaric acid, phthalic acid, glycolic acid, salicylic acid, tartaric acid, malic acid, valerianic acid, isovalerianic acid, 1,2,3-benzenetricarboxylic acid, gluconic acid, diglycolic acid, benzoic acid, and dihydroxybenzoic acid. Organic sulfonic acids include, for example, methanesulfonic acid and benzenesulfonic acid. Organic thiocarboxylic acids include, for example, thioacetic acid and thiobenzoic acid. Organic dithiocarboxylic acids include, for example, dithioacetic acid and dithiobenzoic acid. Among them, carboxylic acid is preferred, hydroxycarboxylic acid and mercaptocarboxylic acid are more preferred, and citric acid, thioglycollic acid, and gallic acid are still more preferred.

The content of the organic acid is not particularly limited as long as the pH value of the cleaning liquid is 8 or higher. The content of the organic acid is properly selected depending upon the type of the organic acid and is preferably 0.1 to 8% by mass, more preferably 0.5 to 4.5% by mass, relative to the total amount of the cleaning liquid. When the content is in the above-defined range, the pH value of the cleaning liquid can be maintained in a desired range of 8 or higher, particularly at least 8 to lower than 11 and the capability of removing residue materials that remain after the etching process can be enhanced while suppressing the corrosion of at least one metal selected from the group consisting of cobalt and alloys thereof.

[Water-Soluble Organic Solvent]

The cleaning liquid according to the present invention may further contain a water-soluble organic solvent. Compounds commonly used in the art may be used as the water-soluble organic solvent. Water-soluble organic solvents may be used solely or in a combination of two or more thereof.

Examples of water-soluble organic solvents include sulfoxides such as dimethyl sulfoxide; sulfones such as dimethyl sulfone, diethyl sulfone, bis(2-hydroxyethyl) sulfone, and tetramethylene sulfone; amides such as N,N-dimethyl formamide, N-methyl formamide, N,N-dimethyl acetamide, N-methyl acetamide, and N,N-diethyl acetamide; lactams such as N-methyl-2-pyrolidone, N-ethyl-2-pyrolidone, N-hydroxymethyl-2-pyrolidone, and N-hydroxyethyl-2-pyrolidone; lactones such as β-propiolactone, γ-butyrolactone, γ-valerolactone, δ-valerolactone, γ-caprolactone, and ϵ-caprolactone; imidazolidinones such as 1,3-dimethyl-2-imidazolidinone, 1,3-diethyl-2-imidazolidinone, and 1,3-diisopropyl-2-imidazolidinone; polyols such as ethylene glycol, propylene glycol, 1,2-butylene glycol, 1,3-butylene glycol, 2,3-butylene glycol, glycerin, and diethylene glycol; glycol ether solvents such as ethylene glycol monomethyl ether, ethylene glycol monoethyl ether, ethylene glycol monopropyl ether, ethylene glycol monobutyl ether, ethylene glycol monoallyl ether, propylene glycol monomethyl ether, propylene glycol monoethyl ether, propylene glycol monopropyl ether, propylene glycol monobutyl ether, 3-methoxy-3-methyl-1-butanol, diethylene glycol monomethyl ether, diethylene glycol monoethyl ether, diethylene glycol monopropyl ether, diethylene glycol monobutyl ether, diethylene glycol monobenzyl ether, dipropylene glycol monomethyl ether, dipropylene glycol monoethyl ether, dipropylene glycol monopropyl ether, dipropylene glycol monobutyl ether, triethylene glycol monomethyl ether, triethylene glycol monoethyl ether, triethylene glycol monopropyl ether, triethylene glycol monobutyl ether, tripropylene glycol monobutyl ether, ethylene glycol dimethyl ether, diethylene glycol dimethyl ether, triethylene glycol dimethyl ether, tetraethylene glycol dimethyl ether, diethylene glycol methyl ethyl ether, and diethylene glycol diethyl ether; and glycol ester solvents such as ethylene glycol monoacetate, ethylene glycol monomethyl ether acetate, ethylene glycol monoethyl ether acetate, and diethylene glycol monoacetate.

In particular, the water-soluble organic solvent is preferably at least one solvent selected from the group consisting of 3-methoxy-3-methyl-1-butanol, dimethyl sulfoxide, propylene glycol monomethyl ether, propylene glycol monoethyl ether, propylene glycol monopropyl ether, diethylene glycol monoethyl ether, and diethylene glycol monobutyl ether.

When the cleaning liquid according to the present invention contains a water-soluble organic solvent, the content of the water-soluble organic solvent is preferably 1 to 60% by mass, more preferably 10 to 50% by mass, still more preferably 15 to 45% by mass, relative to the total amount of the cleaning liquid. When the content of the water-soluble organic solvent is in the above-described range, the water-soluble organic solvent together with water can dissolve other components as a solvent, particularly stably and homogeneously.

[Other Components]

Other components such as anticorrosive agents and surfactants may be added to the cleaning liquid according to the present invention. The anticorrosive agent is not particularly limited, and examples thereof include imidazole compounds, benzotriazole compounds, and mercapto-group-containing compounds. The surfactant is not particularly limited, and examples thereof include nonionic surfactants, anionic surfactants, cationic surfactants, and amphoteric surfactants.

Method for Cleaning Substrate

The first method for cleaning a substrate according to the present invention includes a cleaning step of cleaning the surface of a substrate having a metallic area using the cleaning liquid according to the present invention, the metallic area having, on at least a part of a surface thereof, a metallic layer formed of at least one metal selected from the group consisting of cobalt and alloys thereof.

Figure 1B:
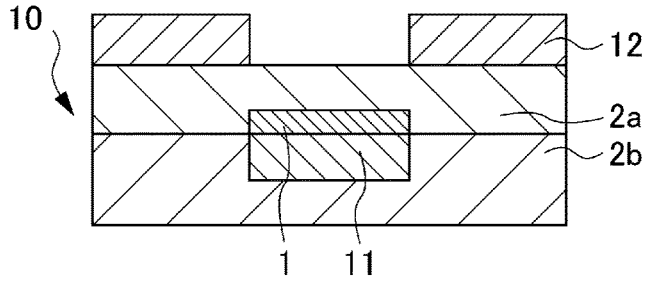
Figure 1C:
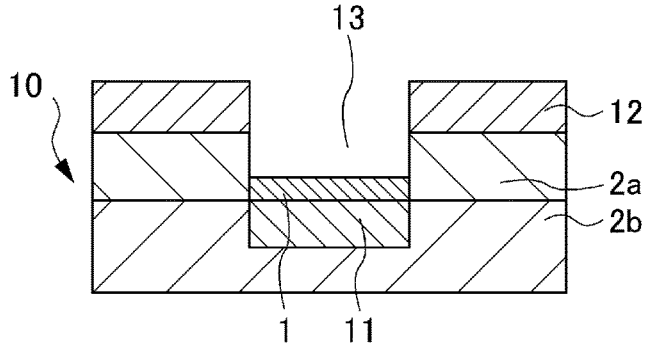
Figure 1D:
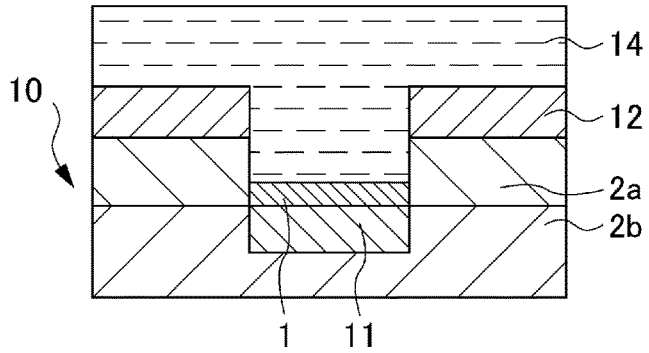

The second method for cleaning a substrate according to the present invention includes: an etching mask layer formation step of forming an etching mask layer of a predetermined pattern on the surface of a substrate having a metallic area, the metallic area having, on at least a part of a surface thereof, a metallic layer formed of at least one metal selected from the group consisting of cobalt and alloys thereof; an etching step of etching the substrate exposed from the etching mask layer; and a cleaning step of cleaning the etched substrate with the cleaning liquid according to the present invention, wherein, in the cleaning, at least a part of the metallic layer is exposed on the surface of the substrate. The second method for cleaning a substrate in one embodiment according to the present invention is described hereafter with reference to FIG. 1.

[Etching Mask Layer Formation Step]

In the etching mask layer formation step, as illustrated in FIGS. 1(*a*) and 1(*b*), an etching mask layer 12 of a predetermined pattern is formed on the surface of a substrate 10 having a metallic area 11, the metallic area 11 having, on at least a part of a surface thereof, a metallic layer 1 formed of at least one metal selected from the group consisting of cobalt and alloys thereof. For example, a capping layer for a metallic wiring may be mentioned as the metallic layer 1. FIG. 1 particularly illustrates a case where the metallic layer 1 is a capping layer for a metallic wiring. The metallic layer 1 and the metallic area 11 are embedded in insulating layers 2*a* and 2*b*. The material for the etching mask layer 12 is not particularly limited. Materials suitable for the etching mask layer 12 include, for example, various resist materials and inorganic silicon compounds such as $SiO_2$ and SiN. When the etching mask layer 12 is formed of a resist material, the etching mask layer 12 is formed by a conventional, publicly known photolithography method. When the etching mask layer 12 is formed of an inorganic silicon compound, the etching mask layer 12 can be formed by forming a thin layer of an inorganic silicon compound on the surface of the substrate 10, forming a resist pattern having openings at places corresponding to openings of the etching mask layer 12 on the thin layer of the inorganic silicon compound, separating the thin layer of the inorganic silicon compound exposed from the openings of the resist pattern by etching, and then removing the resist pattern. Alternatively, the etching mask layer 12 may be formed by forming a resist pattern having openings at places corresponding to the etching mask layer 12, then depositing an inorganic silicon compound on the openings of the resist pattern by CVD, and then removing the resist pattern.

[Etching Step]

In the etching step, as illustrated in FIGS. 1(*b*) and 1(*c*), the substrate 10 exposed from the etching mask layer 12 is etched to form concaves 13. At least a part of the metallic layer 1 is exposed on the surface of the substrate 10 by the formation of the concaves 13. In the etching step, the substrate 10 exposed from the etching mask layer 12 can be etched by any etching method without particular limitation, and examples thereof include dry etching using plasma (for example, oxygen or argon) or corona discharge.

[Cleaning Step]

In the cleaning step, as illustrated in FIG. 1(*d*), the etched substrate 10 is cleaned with the cleaning liquid 14 for lithography according to the present invention. In this case, at least a part of the metallic layer 1 is exposed on the surface of the substrate 10 and thus comes into contact with the cleaning liquid 14. The cleaning liquid 14 has an excellent function of suppressing corrosion of at least one metal selected from the group consisting of cobalt and alloys thereof. By virtue of this, even when the cleaning liquid 14 comes into contact with the metallic layer 1, the corrosion of the metallic layer 1 is successfully suppressed. Thus, when the cleaning step is carried out, the residue material that remains after the etching process can be effectively removed while suppressing the corrosion of the metallic layer 1.

EXAMPLES

The present invention will be described in more detail with the following Examples, but is not limited to the Examples.

(Materials)

Amine compound 1: tetrahydrofurfurylamine
Amine compound 2: N-(2-aminoethyl)piperazine
Amine compound 3: 1,8-diazabicyclo[5.4.0]undecene-7
Amine compound 4: 1,4-diazabicyclo[2.2.2]octane
TMAH: tetramethylammonium hydroxide TBAH: tetrabutylammonium hydroxide
BeTMAH: benzyltrimethylammonium hydroxide
Organic acid 1: citric acid
Organic acid 2: thioglycollic acid
Organic acid 3: gallic acid
Solvent 1: 3-methoxy-3-methyl-1-butanol Amine compounds 1 to 4 are represented by the following formulae (a2) to (a5).

(a2)

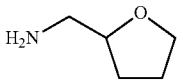

(a3)

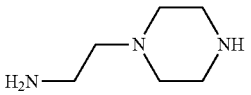

(a4)

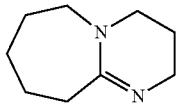

(a5)

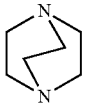

(Preparation of Cleaning Liquid for Lithography)

Materials specified in Table 1 or 2 were mixed in respective amounts specified in Table 1 or 2 (unit: % by mass) to prepare cleaning liquids for lithography. For individual reagents, generally commercially available reagents were used, unless otherwise specified.

(Evaluation of Capability of Removing Etching Residue Material)

A resin composition (TBLM-800 EM, manufactured by Tokyo Ohka Kogyo Co., Ltd.) for a carbon-based hard mask (hereinafter referred to as "C-HM") was dropped onto a silicon substrate with a 30 nm-thick Ti layer formed on the surface thereof, and this substrate was rotated at 2000 rpm to spread the composition across the whole area of the substrate to form an even layer. Thereafter, heat treatment for drying and crosslinking of the resin was carried out at 220° C. for 90 sec to obtain a C-HM having a layer thickness of 1400 angstroms.

Next, the above C-HM was subjected to dry etching under the following conditions to obtain an etching residue material of C-HM (that is, C-HM in a thin layer form that remained on the silicon substrate). The layer thickness after dry etching was about 400 angstroms.

Apparatus: TCA-3822 (manufactured by Tokyo Ohka Kogyo Co., Ltd.)
Power: 800 W
Pressure: 40 Pa
Stage temp: 40° C.
Gas: $CF_4$, 300 ml/min
Time: 3 min The substrate after dry etching was immersed in the cleaning liquid heated to 55° C. for 5 mins. After the completion of immersion, the substrate was rinsed with pure water and cut perpendicularly to a main plane of the substrate. The cut plane was observed under SEM to examine whether or not the etching residue material was removed. When the etching residue material was fully removed, the capability of removing residue materials was evaluated as good. When the etching residue material was partially removed, the capability of removing residue materials was evaluated as fair. On the other hand, when the etching residue material remained on the whole area, the capability of removing residue materials was evaluated as poor. The results are shown in Table 1.

(Evaluation of Etching Rate of Cobalt Layer or Tungsten Layer)

Cobalt or tungsten was deposited on a silicon substrate with 30 nm-thick Ti layer formed on the surface thereof to obtain a substrate including a 100 nm-thick cobalt layer or tungsten layer. This substrate was immersed in the cleaning liquid heated to 55° C. for 60 min. After the completion of immersion, the substrate was rinsed with pure water, the thickness of the cobalt layer or the tungsten layer was measured, and the etching rate of the cobalt layer or the tungsten layer was determined from the difference in layer thickness between before the immersion and after the immersion. The results are shown in Table 1 or 2. When the etching rate was not more than 1.0 nm/min, the function of suppressing corrosion of cobalt was evaluated as excellent while, when the etching rate was no more than 0.100 nm/min, the function of suppressing corrosion of cobalt was evaluated as particularly excellent. Further, when the etching rate was no more than 0.20 nm/min, the function of suppressing corrosion of tungsten was evaluated as excellent.

TABLE 1

| | | Basic compound | | Water- | | | Etching | |
|---|---|---|---|---|---|---|---|---|
| | Hydroxyl amine (mass %) | Amine compound (mass %) | Quaternary ammonium hydroxide (mass %) | soluble organic solvent (mass %) | Water | pH | rate of cobalt layer (nm/min) | Residue removing capability |
| Example 1 | (10) | Amine compound 1 (5) | — | Solvent 1 (20) | (Balance) | 11.25 | 0.100 | Good |
| 2 | (10) | Amine compound 1 (10) | — | Solvent 1 (20) | (Balance) | 11.48 | 0.094 | Good |
| 3 | (10) | Amine compound 1 (15) | — | Solvent 1 (20) | (Balance) | 11.66 | 0.089 | Good |
| 4 | (10) | Amine compound 1 (20) | — | Solvent 1 (20) | (Balance) | 11.90 | 0.088 | Good |
| 5 | (10) | Amine compound 1 (5) | TMAH (0.5) | Solvent 1 (20) | (Balance) | 12.47 | 0.085 | Good |
| 6 | (10) | — | TBAH (0.5) | Solvent 1 (40) | (Balance) | 12.25 | 0.095 | Good |

TABLE 1-continued

| | Hydroxyl amine (mass %) | Basic compound: Amine compound (mass %) | Basic compound: Quaternary ammonium hydroxide (mass %) | Water-soluble organic solvent (mass %) | Water | pH | Etching rate of cobalt layer (nm/min) | Residue removing capability |
|---|---|---|---|---|---|---|---|---|
| 7 | (10) | — | BeTMAH (0.5) | Solvent 1 (40) | (Balance) | 12.42 | 0.080 | Good |
| 8 | (10) | Amine compound 2 (20) | — | Solvent 1 (20) | (Balance) | 11.99 | 0.094 | Good |
| 9 | (10) | Amine compound 3 (5) | — | Solvent 1 (20) | (Balance) | 12.99 | 0.078 | Good |
| 10 | (10) | Amine compound 4 (40) | — | Solvent 1 (20) | (Balance) | 11.55 | 0.047 | Good |
| 11 | (10) | Amine compound 1 (5) | TMAH (1.5) | Solvent 1 (20) | (Balance) | 12.83 | 0.080 | Good |
| 12 | (8) | Amine compound 1 (5) | TMAH (1.5) | Solvent 1 (20) | (Balance) | 12.93 | 0.085 | Good |
| 13 | (6) | Amine compound 1 (5) | TMAH (1.5) | Solvent 1 (20) | (Balance) | 13.10 | 0.080 | Good |
| 14 | (5) | Amine compound 1 (5) | TMAH (1.5) | Solvent 1 (20) | (Balance) | 13.21 | 0.072 | Fair |
| 15 | (4) | Amine compound 1 (5) | TMAH (1.5) | Solvent 1 (20) | (Balance) | 13.32 | 0.070 | Fair |

As is apparent from Table 1, cleaning liquids of Examples 1 to 15 that had a pH value of 11 or higher were found to be excellent in the capability of removing residue materials that remain after the etching process, as well as in the function of suppressing corrosion of cobalt. It was found that cleaning liquids of Examples 1 to 13 that contained not less than 6% by mass of hydroxylamine and had a pH value of 11 or higher had a particularly excellent capability of removing residue materials that remained after the etching process.

TABLE 2

| | | Hydroxyl amine (mass %) | Basic compound: Amine compound (mass %) | Basic compound: Quaternary ammonium hydroxide (mass %) | Organic acid (mass %) | Water-soluble organic solvent (mass %) | Water | pH | Etching rate (nm/min): Cobalt layer | Etching rate (nm/min): Tungsten layer |
|---|---|---|---|---|---|---|---|---|---|---|
| Example | 16 | (10.0) | Amine compound 1 (5.0) | TMAH (0.5) | — | Solvent 1 (20) | (Balance) | 12.39 | 0.08 | 0.17 |
| | 17 | (10.0) | Amine compound 1 (5.0) | — | — | Solvent 1 (20) | (Balance) | 11.12 | 0.10 | 0.15 |
| | 18 | (10.0) | Amine compound 1 (5.0) | — | Organic acid 1 (1.0) | Solvent 1 (20) | (Balance) | 9.78 | 0.12 | 0.18 |
| | 19 | (10.0) | Amine compound 1 (5.0) | — | Organic acid 1 (3.0) | Solvent 1 (20) | (Balance) | 8.78 | 0.15 | 0.17 |
| | 20 | (10.0) | Amine compound 1 (5.0) | — | Organic acid 1 (3.25) | Solvent 1 (20) | (Balance) | 8.50 | 0.15 | 0.16 |
| | 21 | (10.0) | Amine compound 1 (5.0) | — | Organic acid 1 (3.5) | Solvent 1 (40) | (Balance) | 8.29 | 0.16 | 0.15 |
| | 22 | (10.0) | Amine compound 1 (5.0) | — | Organic acid 1 (4.0) | Solvent 1 (40) | (Balance) | 8.01 | 0.18 | 0.15 |
| | 23 | (10.0) | Amine compound 1 (5.0) | — | Organic acid 2 (3.0) | Solvent 1 (20) | (Balance) | 9.05 | 0.22 | 0.13 |
| | 24 | (10.0) | Amine compound 1 (5.0) | — | Organic acid 3 (6.0) | Solvent 1 (20) | (Balance) | 9.00 | 0.36 | 0.13 |
| Comparative Example | 1 | (10.0) | Amine compound 1 (5.0) | — | Organic acid 1 (5.0) | Solvent 1 (20) | (Balance) | 7.89 | 3.73 | 0.15 |
| | 2 | (10.0) | Amine compound 1 (2.5) | — | Organic acid 1 (10.0) | Solvent 1 (20) | (Balance) | 6.93 | 4.92 | 0.13 |

TABLE 2-continued

| | Hydroxyl amine (mass %) | Basic compound: Amine compound (mass %) | Basic compound: Quaternary ammonium hydroxide (mass %) | Organic acid (mass %) | Water-soluble organic solvent (mass %) | Water | pH | Etching rate (nm/min): Cobalt layer | Etching rate (nm/min): Tungsten layer |
|---|---|---|---|---|---|---|---|---|---|
| 3 | (6.0) | Amine compound 1 (1.0) | — | Organic acid 1 (10.0) | Solvent 1 (20) | (Balance) | 6.00 | 10.69 | 0.12 |
| 4 | (6.0) | Amine compound 1 (1.0) | — | Organic acid 1 (15.0) | Solvent 1 (20) | (Balance) | 4.94 | >10 | 0.10 |

As is apparent from Table 2, the cleaning liquids for lithography of Examples 16 to 24 that had a pH value of 8 or higher were found to be excellent in the function of suppressing corrosion of tungsten, as well as in the function of suppressing corrosion of cobalt. On the other hand, the cleaning liquids for lithography of Comparative Examples 1 to 4 that had a pH value of less than 8 were found to have a poor function of suppressing corrosion of cobalt, although the function of suppressing corrosion of tungsten was excellent.

EXPLANATION OF REFERENCE NUMERALS

1: Metallic layer
2*a*, 2*b*: Insulating layer
10: Substrate
11: Metallic area
12: Etching mask layer
13: Concave
14: Cleaning liquid for lithography according to present invention

What is claimed is:

1. A cleaning liquid comprising:
hydroxylamine;
a basic compound; and
water,
wherein the basic compound is at least one compound selected from the group consisting of amine compounds other than hydroxylamine, and quaternary ammonium hydroxides, and
a pH value is 11 or higher, wherein a content of the hydroxylamine is not less than 6% by mass.

2. The cleaning liquid according to claim 1, wherein the cleaning liquid is for lithography.

3. The cleaning liquid according to claim 1, wherein the cleaning liquid is used to clean a substrate containing at least one metal selected from the group consisting of cobalt and alloys thereof.

4. The cleaning liquid according to claim 1, further comprising an organic acid.

5. The cleaning liquid according to claim 1, wherein the amine compound has a cyclic structure.

6. The cleaning liquid according to claim 1, further comprising a water-soluble organic solvent.

7. A method for cleaning a substrate, the method comprising:
cleaning the surface of a substrate having a metallic area using the cleaning liquid, wherein
the metallic area has, on at least a part of a surface thereof, a metallic layer formed of at least one metal selected from the group consisting of cobalt and alloys thereof,
the cleaning liquid comprises hydroxylamine; a basic compound; and water, and has a pH value of 8 or higher,
a content of the hydroxylamine is not less than 6% by mass based on the cleaning liquid, and
the basic compound is at least one selected from the group consisting of an amine compound other than hydroxylamine, and quaternary ammonium hydroxides.

8. A method for cleaning a substrate, the method comprising:
forming an etching mask layer of a predetermined pattern on a surface of a substrate having a metallic area;
etching the substrate exposed from the etching mask layer; and
cleaning the etched substrate with the cleaning liquid, wherein
the metallic area has, on at least a part of a surface thereof, a metallic layer formed of at least one metal selected from the group consisting of cobalt and alloys thereof, and
in the cleaning, at least a part of the metallic layer is exposed on the surface of the substrate,
the cleaning liquid comprises hydroxylamine; a basic compound; and water, and has a pH value of 8 or higher,
a content of the hydroxylamine is not less than 6% by mass based on the cleaning liquid, and
the basic compound is at least one selected from the group consisting of an amine compound other than hydroxylamine, and quaternary ammonium hydroxides.

9. A method for etching a substrate, the method comprising:
forming an etching mask layer of a predetermined pattern on the surface of a substrate having a metallic area;
etching the substrate exposed from the etching mask layer; and
cleaning the etched substrate with the cleaning liquid, wherein
the metallic area has, on at least a part of a surface thereof, a metallic layer formed of at least one metal selected from the group consisting of cobalt and alloys thereof, and
in the cleaning, at least a part of the metallic layer is exposed on the surface of the substrate,
the cleaning liquid comprises hydroxylamine; a basic compound; and water, and has a pH value of 8 or higher,
a content of the hydroxylamine is not less than 6% by mass based on the cleaning liquid, and
the basic compound is at least one compound selected from the group consisting of an amine compound other than hydroxylamine, and quaternary ammonium hydroxides.

10. A lithography method comprising performing lithography using the cleaning liquid according to claim 1.

11. A method for cleaning a substrate, the method comprising cleaning a substrate containing at least one metal selected from the group consisting of cobalt and alloys thereof with the cleaning liquid, the cleaning liquid comprises hydroxylamine; a basic compound; and water, and has a pH value of 8 or higher, a content of the hydroxylamine is not less than 6% by mass of the cleaning liquid, and the basic compound is at least one compound selected from the group consisting of an amine compound other than hydroxylamine, and quaternary ammonium hydroxides.

12. A cleaning liquid comprising:

hydroxylamine;

an amine compound having a cyclic structure; and water, wherein the amine compound having a cyclic structure is at least one compound selected from the group consisting of tetrahydrofurfurylamine, N-(2-aminoethyl) piperazine, 1,8-diazabicyclo[5.4.0]undecene-7, 1,4-diazabicyclo[2.2.2]octane, hydroxyethylpiperazine, piperazine, 2-methylpiperazine, trans-2,5-dimethylpiperazine, cis-2,6-dimethylpiperazine, 2-piperidine methanol, and 1,5-diazabicyclo[4,3,0]nonene-5, and a pH value is 8 or higher.

13. The cleaning liquid according to claim 12, further comprising a quaternary ammonium hydroxide.

14. A method for cleaning a substrate, the method comprising cleaning the surface of a substrate having a metallic area using a cleaning liquid according to claim 12, wherein the metallic area has, on at least a part of a surface thereof, a metallic layer formed of at least one metal selected from the group consisting of cobalt and alloys thereof.

15. A method for cleaning a substrate, the method comprising:

forming an etching mask layer of a predetermined pattern on a surface of a substrate having a metallic area;

etching the substrate exposed from the etching mask layer; and cleaning the etched substrate with a cleaning liquid according to claim 12, wherein the metallic area has, on at least a part of a surface thereof, a metallic layer formed of at least one metal selected from the group consisting of cobalt and alloys thereof, and in the cleaning, at least a part of the metallic layer is exposed on the surface of the substrate.

16. A method of etching a substrate, the method comprising:

forming an etching mask layer of a predetermined pattern on the surface of a substrate having a metallic area;

etching the substrate exposed from the etching mask layer; and cleaning the etched substrate with a cleaning liquid according to claim 12, wherein the metallic area has, on at least a part of a surface thereof, a metallic layer formed of at least one metal selected from the group consisting of cobalt and alloys thereof, and in the cleaning, at least a part of the metallic layer is exposed on the surface of the substrate.

17. A lithography method comprising performing lithography using a cleaning liquid according to claim 12.

18. A method for cleaning a substrate, the method comprising cleaning a substrate containing at least one metal selected from the group consisting of cobalt and alloys thereof with a cleaning liquid according to claim 12.

* * * * *